US010286234B2

(12) United States Patent
Maples et al.

(10) Patent No.: US 10,286,234 B2
(45) Date of Patent: May 14, 2019

(54) MOISTURE-INSENSITIVE THERMALLY PROTECTIVE MATERIALS AND GARMENTS MADE THEREFROM

(71) Applicant: W. L. Gore & Associates, Inc., Newark, DE (US)

(72) Inventors: Allen Maples, Newark, DE (US); Matthew Decker, Newark, DE (US); Mukesh Jain, Newark, DE (US); William Gorak, Newark, DE (US)

(73) Assignee: W. L. Gore & Associates, Inc., Newark, DE (US)

( * ) Notice: Subject to any disclaimer, the term of this patent is extended or adjusted under 35 U.S.C. 154(b) by 1180 days.

(21) Appl. No.: 14/210,247

(22) Filed: Mar. 13, 2014

(65) Prior Publication Data

US 2014/0259331 A1 Sep. 18, 2014

Related U.S. Application Data

(63) Continuation-in-part of application No. 13/840,728, filed on Mar. 15, 2013, now abandoned.

(51) Int. Cl.
*A62B 17/00* (2006.01)
*A41D 31/00* (2019.01)

(52) U.S. Cl.
CPC ..... *A62B 17/003* (2013.01); *A41D 31/0027* (2013.01)

(58) Field of Classification Search
CPC .. A62B 12/003; A62B 17/00; A41D 31/0022; A41D 31/0027; A41D 13/00; D10B 2501/04
USPC ..... 428/920, 921; 442/136–146, 301–303, 442/414
See application file for complete search history.

(56) References Cited

U.S. PATENT DOCUMENTS

| | | | |
|---|---|---|---|
| 4,495,238 | A | 1/1985 | Adiletta |
| 4,502,153 | A | 3/1985 | Lapedes et al. |
| 4,588,635 | A | 5/1986 | Donovan |
| 4,816,328 | A | 3/1989 | Saville et al. |
| 4,862,730 | A | 9/1989 | Crosby |
| 4,992,327 | A | 2/1991 | Donovan et al. |
| 5,136,723 | A | 8/1992 | Aldridge et al. |
| 5,236,769 | A | 8/1993 | Paire |
| 5,640,718 | A | 6/1997 | Aldridge |

(Continued)

FOREIGN PATENT DOCUMENTS

| | | | |
|---|---|---|---|
| CN | 101036536 A | 9/2007 | |
| EP | 2186428 | 11/2009 | |
| WO | WO 2011131675 A1 * | 10/2011 | ..... A41D 31/0027 |

OTHER PUBLICATIONS

Das, Brojeswari, Moisture Transmission Through Textiles Part I: Processes involved in moisture transmission and the factors at play, AUTEX Research Journal, vol. 7, No. 2, Jun. 2007.*

(Continued)

*Primary Examiner* — Jeremy R Pierce
(74) *Attorney, Agent, or Firm* — Greenberg Traurig, LLP

(57) ABSTRACT

Protective garments and methods for low wet pick-up from hose water, weather, etc. and from perspiration generated by the wearer, to minimize water impact on the insulative properties, minimize weight gain, and effectuate quick drying. For firefighting in particular, the disclosure provides that wet, hot air is driven out of the garment, away from the wearer (rather than in), and water entry is blocked.

28 Claims, 3 Drawing Sheets

(56) References Cited

U.S. PATENT DOCUMENTS

| | | | | |
|---|---|---|---|---|
| 5,697,101 | A | 12/1997 | Aldridge | |
| 5,819,316 | A | 10/1998 | Aldridge | |
| 5,860,163 | A | 1/1999 | Aldridge | |
| 5,983,409 | A | 11/1999 | Aldridge et al. | |
| 6,192,520 | B1 | 2/2001 | Underwood et al. | |
| 6,341,384 | B1 | 1/2002 | Hayes | |
| 6,397,401 | B2 | 6/2002 | Belcher | |
| 6,430,754 | B1 | 8/2002 | Taylor et al. | |
| 6,687,913 | B2 * | 2/2004 | Aldridge | A62B 17/003 2/272 |
| 2010/0287680 | A1 * | 11/2010 | Johnson | B32B 27/12 2/87 |
| 2013/0198941 | A1 * | 8/2013 | John | A41D 31/0027 2/455 |

OTHER PUBLICATIONS

International Search Report, PCT-US2014/027402, 4 pages, Jul. 14, 2014.

* cited by examiner

MOISTURE-INSENSITIVE THERMALLY PROTECTIVE MATERIALS AND GARMENTS MADE THEREFROM

CROSS-REFERENCE TO RELATED APPLICATIONS

This application is a continuation of U.S. patent application Ser. No. 13/840,728, filed Mar. 15, 2013, now abandoned.

BACKGROUND

The present disclosure relates to garments and liners for garments worn for protection from a hazardous environment, and more particularly, to such liners and garments worn by firefighters for protection from extreme heat, moisture and abrasion.

Protective garments are designed to shield a wearer from a variety of environmental hazards, and firefighter garments are representative of such garments. Many conventional firefighting ensembles comprise a turnout coat and pant, each of which includes an outer shell, a moisture barrier located beneath the outer shell, a thermal liner located beneath the moisture barrier, and an innermost face cloth layer often bonded to the thermal liner.

The outer shell typically is constructed of an abrasion-, flame- and heat-resistant material such as a woven aramid material, typically NOMEX or KEVLAR (both are trademarks of E.I. DuPont de Nemours & Co., Inc.) or a polybenzimidazole such a PBI (a trademark of Celanese Corp.) fiber material.

The moisture barrier, such as CROSSTECH® moisture barriers (a trademark of W.L. Gore & Associates, Inc.), typically includes a membrane layer which is moisture vapor permeable but impermeable to liquid moisture. The membrane layer is typically bonded to a substrate of at least one flame- and heat-resistant material, such as an aramid or polybenzimidazole material.

The thermal liner typically comprises one or more layers of insulation material, such as relatively thick layers of aramid fiber batting in the form of needlepunched or spunlaced textiles, which are often quilted to a lightweight aramid-containing fabric substrate or face cloth. The batting of the thermal barrier traps air and possesses sufficient loft to provide the necessary thermal resistance, and the fabric substrate protects the batting of the thermal liner from abrasion from the wearer and provides a sensorially appropriate surface.

The aforementioned components conventionally are arranged within the garment so that the moisture barrier layer is positioned between the thermal liner and the outer shell. This is done, in part, to prevent the insulating material of the thermal liner from absorbing an excessive amount of liquid moisture from the ambient environment, for example from fire hose spray or rain, which undesirably increases the overall weight of the garment, and can reduce the thermal resistance characteristics due to water's high thermal conductivity compared to air, increasing risk of burn injury.

A limitation inherent in such an arrangement is that perspiration from the wearer may be absorbed by the thermal liner which can also cause the adverse consequences described.

It is important to note that moisture may also find its way into the various layers of a garment via diffusion and condensation mechanisms. That is, moisture which may be initially localized to an inner or outer layer can move to other locations in the form of water vapor, and may condense in those locations under the appropriate conditions. This means that simply blocking the physical transport of liquid water may not be sufficient in all cases to ensure the appropriate level of thermal protection is maintained.

Moisture within the layers of the garment can also serve as a source for hazardous convective air movement. In firefighting, a situation known as flashover can occur when there is a near-simultaneous ignition of most of the directly exposed combustible material in an enclosed area, and significant heat exposure will occur, and the ability of a garment to provide protection from burn injury may only be a matter of seconds to a few minutes. Lower levels of heat exposure for longer periods of time are also hazardous.

Upon heating, for example from hazardous radiant exposure from a fire at conditions below flashover levels (sub-flashover), air and any moisture present within the layers of the garment will heat up. Air when laden with moisture can hold significant and hazardous amounts of heat energy, much more so than dry air. As this moisture-laden air expands and moves through the layers of the garment, it can pose serious risk of burn injury if it moves toward the body of the wearer.

The impact of this moisture within the protective garment layers can be highly unpredictable to a wearer of the garment. That is, a wearer, for example a firefighter, may be unable to foresee how much thermal protection has been compromised by moisture in the garment, and so may not be able to effectively adjust their actions to the new level of risk. Additionally, moisture in the garment can reduce the "alarm-time", the time between when a wearer may begin to feel pain due to hazardous thermal exposure, and when they may experience a second-degree burn injury. This time between pain and burn (also known as escape time), is the critical time a wearer, for example a firefighter, has to reduce their thermal exposure before being severely burned. In many realistic end-use scenarios for wearers of such protective garments, even small differences such as a few lost seconds in time-to-burn and alarm-time can result in serious injury.

Accordingly, there is a need for a protective garment in which the susceptibility to reduced thermal protection due to moisture is minimized.

Attempts have been made to address some of these disadvantages in such conventional protective garments, particularly firefighting garments, by, for example, incorporating water repellant finishes on and within various layers of the garment. It is well known that these finishes have limited effectiveness and limited durability, particularly in the harsh environments common to firefighters. Other attempts have included the use of inherently non-water-absorbing insulative or barrier materials, such as rubber coatings, neoprene layers or closed-cell foams. However, these materials have the undesirable property of being highly impermeable to moisture vapor diffusion, reducing the ability of the wearer to shed heat by the evaporation of perspiration. This high resistance to evaporative transport can result, for example, in elevated core temperatures of the wearer, potentially causing heat stress, heat stroke, and diminished cognitive function, as well as an increase in retained moisture in the system posing additional risk of thermal injury. Further, many of these approaches are no longer consistent with current industry standards, and so can not be used in many protective apparel applications.

SUMMARY

The present disclosure is directed to a protective garment that has low wet pick-up from environmental sources such as hose water and weather, and from perspiration generated by the wearer, such that there is minimal impact on the insulative properties of the garment, minimal weight gain by exposure to moisture, and an effective ability to quickly dry out between uses. The present disclosure provides more predictable and consistent insulation in both wet and dry conditions than conventional firefighting garments, and has an extended alarm time (difference between time-to-pain and time-to-burn) relative to conventional firefighting garments. Additionally, the present disclosure allows the construction of firefighting garments with improved mobility (e.g., relatively thin and lightweight), NFPA 1971 compliance, EN469 compliance, resistance to liquid penetration, durability of performance, and donning and doffing ease. In addition, the present disclosure allows the construction of firefighting garments with improved subflashover heat protection due to radiative exposure, good conductive resistance under compression, adequate steam burn resistance, and convective heat transfer resistance. Moreover, the present invention allows the construction of firefighting garments with improved flashover heat protection, as measured by Pyroman testing (e.g., via ASTM 1930-12), and thermal protective performance testing contained within NFPA 1971 and EN 469 standards. In alternative embodiments, turnout garments having the constructions of the present invention can exhibit total percent body burn performance, as described in the test methods herein, of 45% or less, alternatively 40% or less, and alternatively 37% or less. Finally, the present disclosure allows the construction of firefighting garments which provide lower heat stress for the wearer relative to conventional garments, minimizing the resistance to evaporative transport, and in particular evaporative heat transfer performance testing as contained within NFPA 1971 and EN 469 standards. In particular, the layers of the construction will provide a resistance to evaporative transport, as measured by Ret, of less than 50 $m^2Pa/W$, and alternatively of less than 25 $m^2Pa/W$.

Unless defined otherwise, all technical and scientific terms used herein have the same meaning as commonly understood by one of ordinary skill in the art to which the invention belongs. Although any methods and materials similar or equivalent to those described herein can be used in the practice or testing of the present invention, the preferred methods and materials are described herein.

An object is a protective garment construction comprising an outer layer, an air permeable, liquid water resistant membrane, an insulation and an air impermeable, liquidproof, moisture vapor permeable membrane, wherein the air permeable, liquid water resistant membrane film is positioned closer to the outer layer than the air impermeable, liquidproof, moisture vapor permeable membrane, and the insulation is located between the air permeable, liquid water resistant membrane and the air impermeable, liquidproof, moisture vapor permeable membrane.

Another object is a protective garment which may have an air permeable, liquid water resistant membrane contained within a separable component comprising fire resistant textiles. In another embodiment, the protective garment may have an air impermeable, liquidproof, moisture vapor permeable membrane contained within a separable component comprising fire resistant textiles. As used herein, the term "separable" is intended to refer to a component which is not substantially bonded to an adjacent component across its surface, but may be bonded around its perimeter to the perimeter of adjacent component(s) by stitching or other means to fix the components together, but on removal of the stitching or other means, the components are readily separated from one another and are no longer bonded.

In another embodiment, the protective garment has insulation which is in a separable layer positioned between the air permeable, liquid water resistant membrane and the air impermeable, liquidproof, moisture vapor permeable membrane. In a further embodiment, the protective garment has a construction wherein at least a portion of the insulation is attached to the air permeable, liquid water resistant membrane. Alternatively, the disclosure is directed to a protective garment wherein at least a portion of the insulation is attached to the air impermeable, liquidproof, moisture vapor permeable membrane. In a further alternative embodiment, the protective garment comprises insulation wherein a first portion of insulation attached to the air permeable, liquid water resistant membrane, a second portion of insulation attached to the air impermeable, liquidproof, moisture vapor permeable membrane, and a third portion of insulation is incorporated as a separable component between the first portion and the second portion.

In a further embodiment, the protective garment comprises a construction wherein the air permeable, liquid water resistant membrane has a moisture vapor transmission rate (MVTR) which is at least 2 times greater than the MVTR of the air impermeable, liquidproof, moisture vapor permeable membrane. In another embodiment, the protective garment comprises an air permeable, liquid water resistant membrane comprising an oleophobic film. In a further alternative embodiment, the protective garment comprises an air impermeable, liquidproof, moisture vapor permeable membrane comprising an oleophobic film. By "oleophobic" is meant a film having oil resistance with an oil rating of at least one 1 or more, alternatively at least 2 or more, and alternatively at least 4 or more.

In an alternative embodiment, the protective garment comprises an air permeable, liquid water resistant membrane having at least a 30% higher MVTR than the air impermeable, liquidproof, moisture vapor permeable membrane. In further embodiments, the protective garment may comprise a construction wherein the air impermeable, liquidproof, liquid water resistant membrane is incorporated within a laminate of flame-resistant materials and comprises an oleophobic expanded PTFE membrane, and said air impermeable, liquidproof, moisture vapor permeable membrane is incorporated within a laminate of flame-resistant materials and comprises a bi-component expanded PTFE membrane. In a further embodiment, the protective garment may comprise an outer layer, an air permeable, liquid water resistant membrane, an insulation, and an air impermeable, liquidproof, moisture vapor permeable membrane, wherein the air permeable, liquid water resistant membrane film is positioned closer to the outer layer than the air impermeable, liquidproof, moisture vapor permeable membrane, and the insulation is located between the air permeable, liquid water resistant membrane and the air impermeable, liquidproof, moisture vapor permeable membrane, and further wherein the air permeable, liquid water resistant film/membrane, the insulation and the air impermeable, liquidproof, moisture vapor permeable membrane are separable across their surfaces.

A further embodiment is directed to a method of simultaneously protecting insulative materials from bulk liquid absorption while directing heated moisture vapor away from the skin of a protective garment wearer comprising the steps of providing (a) an air permeable, liquid water resistant membrane; (b) providing insulation; (c) providing an air impermeable, liquidproof, moisture vapor permeable membrane; and (d) arranging the materials of (a), (b) and (c) in a protective garment to be worn by the wearer such that said air impermeable, liquidproof, moisture vapor permeable membrane is closer to the wearer and the air permeable, liquid water resistant membrane is closer to the exterior of the garment, and said insulation is arranged therebetween. In a further embodiment of this method, the air permeable, liquid water resistant membrane has a moisture vapor permeability which is higher than the moisture vapor permeability of the air impermeable, liquidproof, moisture vapor permeable membrane. In a further alternative embodiment, the method further comprising providing in the garment an outer shell arranged to the exterior relative to the air permeable, liquid water resistant membrane.

In further alternative embodiments, at least one additional air impermeable, liquidproof, moisture vapor permeable membrane may be present within the construction oriented between a first air impermeable, liquidproof, moisture vapor permeable membrane, as described, and the air permeable, liquid water resistant film/membrane, which is oriented closer to the exterior of the garment. As well, at least one additional air permeable, liquid water resistant film/membrane may be provided in the construction provided the at least one additional air permeable, liquid water resistant film/membrane is oriented closer to the exterior of the garment than the at least one air impermeable, liquidproof, moisture vapor permeable membrane. Interlayer contact and slippage of such film/membrane layer in some constructions may enhance wearer comfort in use.

As noted above, provided is a method and garment that balances the features of effectively preventing bulk water entry from both environmental sources and the wearer, as well as forcing wet, dangerously hot air out, away from the wearer (rather than in), thus better maintaining desired insulative properties found in the dry condition, even when challenged by hazardous thermal exposures in wet conditions.

The object is realized by incorporating dual and distinctively different liquid water barriers within the garment, ensuring that the innermost liquid water barrier of the two is a membrane which is air impermeable, liquidproof (and thus, liquid water impermeable), but moisture vapor permeable, or permeable, and that the outermost, liquid water barrier layer of the two is a membrane which is air (and thus, at least somewhat moisture vapor) permeable, but liquid water resistant, and positioning at least a portion of materials important to the desired insulative properties of the garment between the dual and distinctively different liquid water barriers. The term "membrane" will be used herein purely for simplicity to refer to either membranes or films, with or without coatings, or which may be produced or incorporated as coatings, which are within the scope contemplated.

The protective garment is desirably compliant with NFPA 1971 Standard 2007 edition, or with EN 469 Standard 2005 edition, and ideally both. In various alternative embodiments, the air permeable, liquid water resistant membrane may be incorporated within a laminate of flame-resistant materials and expanded oleophobic PTFE membrane, and the air impermeable, liquidproof, moisture vapor permeable membrane is incorporated within a laminate of flame-resistant materials. Alternative embodiments contemplate the air permeable, liquid water resistant membrane incorporated within a laminate of flame-resistant textile materials sandwiching an oleophobic expanded PTFE membrane, and the air impermeable, liquidproof, moisture vapor permeable membrane incorporated within a laminate of flame-resistant textile materials sandwiching a expanded PTFE film. Alternatively, the garment may further comprise non-breathable trim directly attached on the environment-facing surface of the outer layer; and the garment composite with the trim has a time-to-burn of greater than 130 seconds per ASTM F2731 using NFPA 1971 2013 edition test criteria. In certain embodiments, the garment composite has a time-to-burn in wet conditions greater than or equivalent to its time-to-burn in dry conditions per ASTM F2731 using modified wet and dry test criteria respectively without compression.

In another aspect, provided is a method of directing heated moisture vapor away from the skin of a thermally protective garment wearer comprising the steps of providing an air permeable, liquid water resistant membrane; providing insulative materials; providing an air impermeable, liquidproof, moisture vapor permeable membrane; and arranging the layers of the protective garment such that the air impermeable, liquidproof, moisture vapor permeable membrane is closer to the skin of the wearer and the air permeable, liquid water resistant membrane is closer to the exterior of the garment, and the insulative materials are arranged to be therebetween. Further, an outer shell material may be positioned externally relative to the air permeable, liquid water resistant membrane.

DETAILED DESCRIPTION

Figure 1:
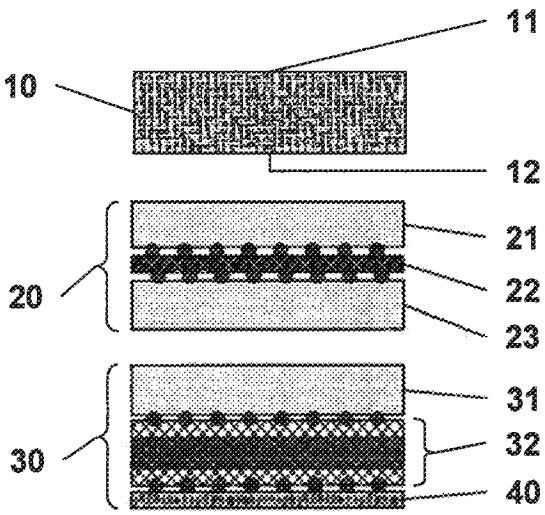
FIG. 1 is a schematic exploded side view of an exemplary embodiment.

Exemplary embodiments will now be described in connection with the illustrative drawings appended hereto. In a first exemplary embodiment depicted in FIG. 1, the layers of the inventive garment are shown with outer shell 10 having an environment-facing surface 11 and an inward-facing surface 12. The first separable composite layer 20 is disposed adjacent to inward-facing surface 12 of outer shell 10. The second separable composite layer 30 is disposed adjacent to first separable composite layer 20, such that first separable composite layer 20 is sandwiched between outer shell layer 10 and second separable composite layer 30.

Outer shell 10 may comprise, in alternative embodiments, an abrasion-, flame- and heat-resistant material such as a woven aramid material, typically NOMEX or KEVLAR (both are trademarks of E.I. DuPont de Nemours & Co., Inc.) or a polybenzimidazole such a PBI (a trademark of Celanese Corp.) fiber material or a polybenzoxazole fiber.

The first separable composite layer 20 is itself comprised of multiple sub-layers (three in the illustrated embodiment). Light, flame resistant, nonwoven material 21, in some embodiments comprising an aramid, is provided to assist with durability. The air permeable, liquid water resistant membrane 22 is provided to prevent ambient liquid from penetrating into the more inward layers and spaces within the garment. This air permeable, liquid water resistant membrane may comprise, for example, an expanded PTFE.

Depending on the desired performance, in an alternative embodiment, this membrane may be oleophobic, in order to minimize oils and other liquid from penetrating and contaminating the garment layers positioned interior to this layer. Insulation 23 comprising in this embodiment flame resistant nonwoven material is disposed on the opposite side of the air permeable, liquid water resistant membrane 22 from woven material 21. Insulation material 23 and nonwoven material 21 are dot-laminated, for example using polyurethane-based adhesives. Flame-resistant rayon nonwoven materials and melamine-based nonwoven material may also be used, for example, in alternative embodiments, for example for flame resistant nonwoven material 23.

The second separable composite layer 30 itself comprises multiple sub-layers as well. Insulation 31, again suitably a flame resistant nonwoven material, may have the same constituent alternative materials as flame resistant nonwoven material 23 discussed above. It is dot-laminated to air impermeable, liquidproof, moisture vapor permeable membrane 32. This particular construction and arrangement helps drive heated moisture vapor, particularly from moisture retained between membranes 22 and 32, preferentially outward toward the environment, thus protecting the wearer. Air impermeable, liquidproof, moisture vapor permeable membrane 32 may comprise a bi-component expanded PTFE membrane, such as contained in CROSSTECH® moisture barriers produced by W. L. Gore & Associates, Inc. These bi-component expanded PTFE membranes are generally comprised of expanded PTFE membranes and monolithic coatings of moisture vapor permeable polymers, such as moisture vapor permeable polyurethanes. The bi-component air impermeable, liquidproof, moisture vapor permeable membrane 32 in this particular illustration is comprised of two expanded PTFE membranes combined with and sandwiched around a monolithic moisture vapor permeable polymer. Face material 40 is disposed on the innermost portion of the garment, and in this embodiment is dot laminated to air impermeable, liquidproof, moisture vapor permeable membrane 32. This layer provides a comfortable feel and ideally low friction engagement with the wearer.

Figure 2:
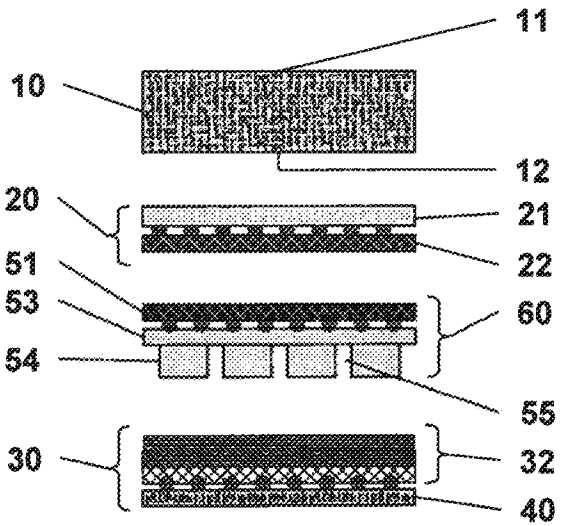
FIG. 2 is a schematic exploded side view of another exemplary embodiment.

FIG. 2 illustrates an alternative embodiment. In this embodiment, as with FIG. 1, the inventive garment layers are shown with outer shell 10 having an environment-facing surface 11 and an inward-facing surface 12. The first separable composite layer 20 is itself comprised of sub-layers. A light, flame resistant, woven material 21, in one embodiment comprising an aramid, is provided to assist with durability. The air permeable, liquid water resistant membrane 22 is provided to prevent ambient liquid from penetrating into the more inward layers and spaces within the garment. Separable component 60 comprises a two-layer construction of an olephobic membrane 51 which is dot-laminated with adhesive to an insulation 53 which in this embodiment comprises a flame resistant nonwoven material having some three-dimensional structure in the insulation, in this embodiment depicted by peaks 54 and valleys 55, whereby air within the valleys 55 may contribute insulative characteristics to the construction. Separable component 30 comprises a bi-component air impermeable, liquidproof, moisture vapor permeable membrane 32, and in this particular illustration is comprised of expanded PTFE membrane combined with a monolithic moisture vapor permeable polymer such as moisture vapor permeable polyurethane. The separable component 30 further comprises a face material 40 dot-laminated on the innermost portion of the garment. This face material 40 provides a comfortable feel and ideally low friction engagement with the wearer.

Figure 3:
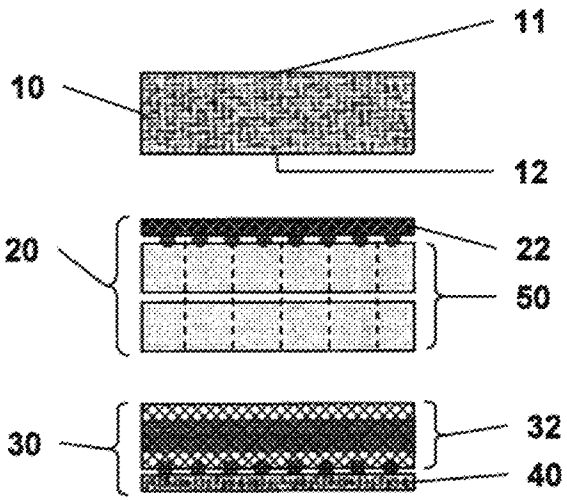
FIG. 3 is a schematic exploded side view of another exemplary embodiment.

FIG. 3 illustrates an alternative embodiment. This embodiment has the same basic structure as the embodiment of FIG. 1, with outer shell 10, a separable component 20 and a separable component 30. In this embodiment, however, separable component 20 comprises air permeable, liquid water resistant layer 22, such that the air permeable, liquid water resistant layer 22 is disposed directly adjacent outer shell 10. In addition, in this embodiment, layer 22 is dot-laminated to two layers of quilted flame resistant nonwoven 50 which provide insulation. Finally, the separable component 30 of this embodiment has the air impermeable, liquidproof, moisture vapor permeable membrane 32, which in this embodiment is a bi-component expanded PTFE membrane such as contained in CROSSTECH® moisture barriers produced by W. L. Gore & Associates, Inc., laminated to a face fabric 40. Again, these bi-component expanded PTFE membranes are generally comprised of expanded PTFE membranes and monolithic coatings of moisture vapor permeable polymers, such as moisture vapor permeable polyurethanes. The bi-component air impermeable, liquidproof, moisture vapor permeable membrane 32 in this particular illustration is comprised of two expanded PTFE membranes combined with and sandwiched around a monolithic moisture vapor permeable, or moisture vapor permeable, polymer.

Figure 4:
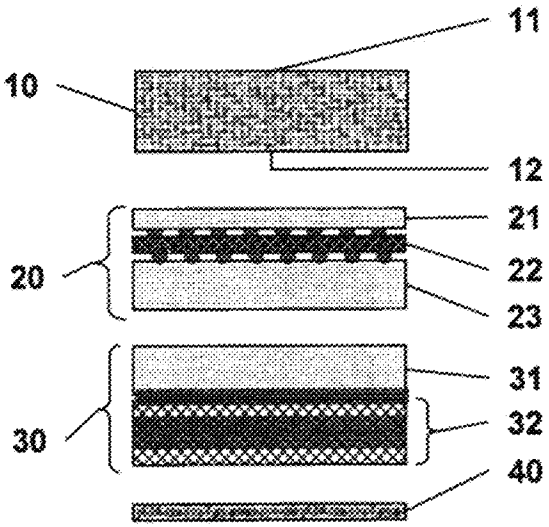
FIG. 4 is a schematic exploded side view of another exemplary embodiment.

FIG. 4 illustrates another alternative embodiment. This embodiment has a basic structure of outer shell 10, separable component 20, separable component 30, and separable face material 40. In this embodiment, air permeable, liquid water resistant membrane layer 22 is disposed between a woven flame resistant textile on the outermost surface of separable component 20 and insulation 23 comprising flame resistant nonwoven. An insulation 31 is attached via continuous moisture vapor permeable adhesive to a bi-component air impermeable, liquidproof, moisture vapor permeable membrane 32 comprised of two expanded PTFE membranes combined with and sandwiched around a monolithic moisture vapor permeable, or moisture vapor permeable, polymer. Separable layer 40, comprised of a flame resistant woven textile, is positioned interior to separable component layer 30 such that it is the layer positioned closest to the wearer of the assembled garment comprised of separable components 10, 20, 30, and 40.

Figure 5:
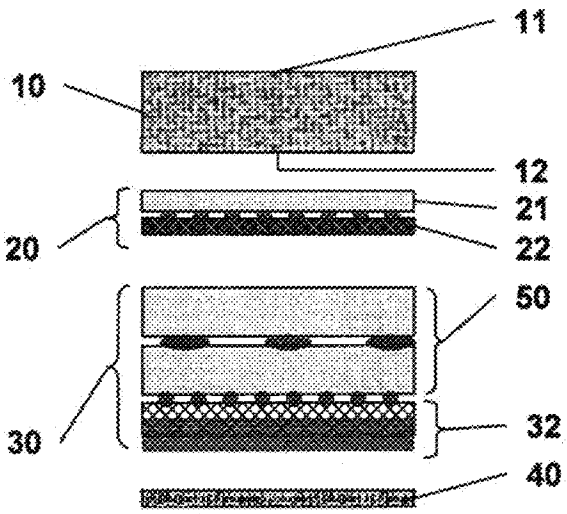
FIG. 5 is a schematic exploded side view of another exemplary embodiment.

FIG. 5 illustrates another alternative embodiment. This embodiment has outer shell 10, separable component 20, separable component 30, and separable component 40. In this embodiment, a flame resistant woven material 21 is dot-laminated to air permeable, liquid water resistant membrane 22 and oriented between membrane 22 and outer shell 10. Flame resistant nonwoven materials are bonded together with discontinuous adhesive to form layer 50 which is dot laminated to air impermeable, liquidproof, moisture vapor permeable membrane 32, to form separable layer 30. Disposed interior to layer 30 is a flame resistant woven textile 40.

Figure 6:
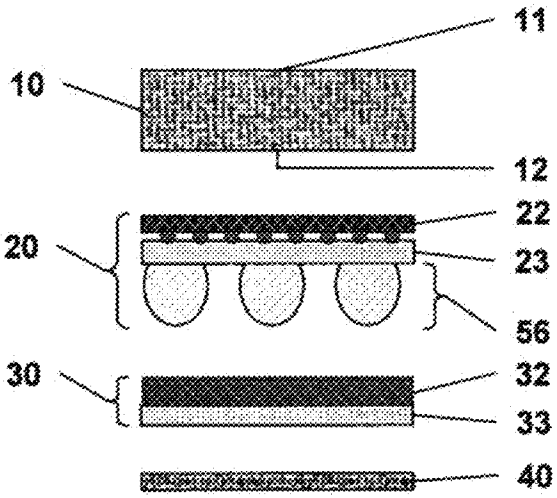
FIG. 6 is a schematic exploded side view of another exemplary embodiment.

FIG. 6 illustrates another alternative embodiment. This embodiment has an outer shell 10, separable component 20, separable component 30, and separable flame resistant textile 40. In this embodiment, separable component 20 is comprised of discrete foamed dots 56 of a silicone compound which creates air spacing and limits compression of the overall system due to the silicone dot modulus versus nonwoven textiles. AIRLOCK® spacer technology from W. L. Gore & Associates, Inc is representative of such silicone foam spacer technology. Additionally, separable component 30 is comprised of a woven flame resistant textile 33 disposed interior to air impermeable, liquidproof, moisture vapor permeable membrane 32, wherein the air impermeable, liquidproof, moisture vapor permeable membrane 32 is formed as a moisture vapor transmissive coating disposed on a woven flame resistant textile. Additionally, a woven flame resistant textile 40 is positioned interior to separable component layer 30.

All of these embodiments share a common inventive feature of an arrangement of layers of a protective garment such that an air impermeable, liquidproof, moisture vapor permeable membrane is provided closer to the skin of the wearer and an air permeable, liquid water resistant membrane is provided closer to the exterior of the garment, and insulative material(s) arranged to be therebetween. In this manner, wet, hot air is driven out of the garment (rather than in) and water entry is blocked, such that bulk water is prevented from soaking through the garment, and enables the thermal protective properties for the wet garment to be relatively consistent with the dry garment thermal protective properties.

Examples of suitable fire-resistant textile materials for use herein include meta-aramids and para-aramids, FR cottons, PBI, PBO, FR rayon, modacrylics, polyamines, carbon, fiberglass, PAN, PTFE, and blends and combinations thereof.

As used herein, the term "air permeable, liquid water resistant membrane" refers to a layer comprising a membrane or film which has a minimum air permeability as measured by a Gurley of less than 200 seconds and a liquid water resistance as measured by a Suter Hydrostatic Pressure Tester of greater than 0.5 psi. In an alternative embodiment, the air permeable, liquid water resistant membrane has minimum air permeability as measured by Gurley of less than 100 seconds, alternatively less than 50 seconds, alternatively less than 25 seconds, and a liquid water resistance as measured by a Suter Hydrostatic Pressure Tester of greater than 4 psi, alternatively greater than 10 psi, and alternatively greater than 20 psi. Air permeable membranes will generally possess interconnected pores or pathways which enable mass transport of air from one side of the layer to the other. The air permeable, liquid water resistant membrane will be moisture vapor permeable.

As used herein, the term "air impermeable, liquidproof, moisture vapor permeable membrane" refers to a layer comprising a membrane or film which has a generally monolithic coating or constituent of a generally contiguous nature with few if any interconnected pores or pathways which could enable significant mass transport of air or liquids from one side of the layer to the other, but which enables moisture vapor transmission, in particular at least partially via solution-diffusion mechanisms. The air impermeable, liquidproof, moisture vapor permeable membrane has an air permeability as measured by Gurley of greater than 200 seconds, a liquid entry pressure of greater than 70 kPa to a liquid having a surface tension of about 31 dynes/cm, and a moisture vapor transmission rate of at least 1000 g/m2/day. In an alternative embodiment, the air impermeable, liquidproof, moisture vapor permeable membrane has a moisture vapor transmission rate of at least 5000 g/m2/day, alternatively greater than 10000 g/m2/day. Also in an alternative embodiment, the air impermeable, liquidproof, moisture vapor permeable membrane has a liquid entry pressure greater than 170 kpa to a liquid having a surface tension of about 31 dynes/cm. Also in an alternative embodiment, the air impermeable, liquidproof, moisture vapor permeable membrane has an air permeability as measured by Gurley of greater than 500 seconds.

In some embodiments, the air permeable, liquid water resistant membranes and the air impermeable, liquidproof, moisture vapor permeable membranes are comprised of expanded PTFE membranes which are tailored to the desired properties identified to provide that wet, hot air is driven out of the garment (rather than in) and water entry is blocked, such that moisture is prevented from soaking through the garment. However, it is recognized that aspects may also be achieved by the use of appropriate coatings or other treatments, in substitution for or in combination with membranes such as expanded PTFE membranes. Such appropriate coatings or treatments may include, for example, discontinuous silicones, moisture vapor permeable continuous polyurethanes or polyesters, and discontinuous fluoropolymer treatments. Additionally, metal coatings such as porous or discontinuous metal coatings may be provided. Further, properties such as oleophobicity or hydrophobicity may be imparted in or on various layers to further support the absorption, retention, or movement of water vapor within the garment in order to provide that wet, hot air is preferentially driven out of the garment (rather than in) and water entry is blocked, such that bulk moisture is prevented from soaking through the garment. In addition to expanded PTFE membranes, use of other membranes such as porous PS, PES, PAN, PVDF or PVC membranes may be possible.

In some embodiments, such as is illustrated in the Figures, the air permeable, liquid water resistant membranes and the air impermeable, liquidproof, moisture vapor permeable membranes are combined with other materials to create separable components containing composite layers which are separable from other layers within the garment. These separable components are generally not bonded to one another across the majority of their surfaces, although they may be attached together at edges, perimeters or at discrete points, for example at seams or sleeve or pant terminations. The air permeable, liquid water resistant membranes and the air impermeable, liquidproof, moisture vapor permeable membranes may be combined with insulative materials, and the air permeable, liquid water resistant membrane may be combined or attached to the outer shell. Also, when a plurality of one such membranes (e.g., in constructions comprising more than one air permeable, liquid water resistant membrane or more than one air impermeable, liquidproof, moisture vapor permeable membrane) are employed, such membranes may be bonded to one another. In alternative embodiments, the protective garment constructions may be provided in the form of separable layers assembled and provided as garment systems.

The insulative materials positioned between the air permeable, liquid water resistant membranes and the air impermeable, liquidproof, moisture vapor permeable membranes may be incorporated with either, both, or neither of the air permeable, liquid water resistant membranes and the air impermeable, liquidproof, moisture vapor permeable membranes as separable composite layers. Preferred means of bonding insulative materials to the air permeable, liquid water resistant membranes and the air impermeable, liquidproof, moisture vapor permeable membranes is by using discontinuous adhesive. Other means of attachment could include continuous but moisture permeable adhesives (where air permeability is not required), or coating of appropriate insulative materials onto or with the air permeable, liquid water resistant membranes and the air impermeable, liquidproof, moisture vapor permeable membranes. Where some or all of the insulative materials positioned between air permeable, liquid water resistant membranes and the air impermeable, liquidproof, moisture vapor permeable membranes are not substantially incorporated into or onto one or both of the air permeable, liquid water resistant membranes and the air impermeable, liquidproof, moisture vapor permeable membranes, the insulative materials may be attached, for example, in localized areas such as the seams of the garment.

Suitable insulative materials may include, but are not limited to, continuous or discontinuous silicone foams, non-woven material, woven material, knitted material, three-dimensionally shaped materials to provide air cavities for insulation, and other suitable insulative components, both passive and active, are contemplated to be within the scope disclosed, and provided the insulation does not prevent the effect that wet, hot air is preferentially driven out of the garment (rather than in). In an alternative embodiment of a suitable insulation of the present invention, water entry may be sufficiently blocked, such that liquids, in particular water, are generally hindered from soaking through the garment.

In addition to garments, and liners for garments, thermally protective constructs made according to the methods may be useful, for example, in footwear, gloves, and headwear.

Test Methods

Subflashover Protection

A convenient test for evaluating composite thermal protection performance in the subflashover thermal environment is ASTM F2731-11, *Standard Test Method for Measuring the Transmitted and Stored Energy of Firefighter Protective Clothing Systems*. The method evaluates composite performance by exposing test specimens, for a test specific amount of time, to 0.2 cal/cm$^2$/sec radiant energy. At the end of exposure, the specimen is compressed against the sensor to measure the energy stored in the test composite. Throughout the test, the energy transmitted to the sensor is collected and, simultaneously, the human skin burn model, detailed within ASTM F2731-11, is applied to the collected energy. Calculations are made to predict the time to a second degree burn. Tests can be performed on specimens using either dry or wet preconditioning and the exposure time can be specified. The moisture preconditioning step within the procedure can be modified to represent a moisture exposure, for example exposure, absorption, and distribution of sweat, into the various layers of a protective garment composite. This is accomplished by uniformly adding the desired amount of water to specific layers of the protective composite by a means that ensures the water is absorbed into the layer. The individual layers are reassembled as they would be found in the protective composite. The reassembled composite is placed in a sealed plastic bag to equilibrate for 18 to 24 hours at 21+/−3° C. The method is useful to study the thermal protection afforded to firefighters by composite constructions in subflashover exposures, and can include additional layers such as undergarments and shirts, pants or other worn layers which may be part of the overall ensemble.

Moisture Vapor Transmission Rate (MVTR)

A description of the test employed to measure moisture vapor transmission rate (MVTR) is given below. The procedure has been found to be suitable for testing films, coatings, and coated products.

In the procedure, approximately 70 ml of a solution consisting of 35 parts by weight of potassium acetate and 15 parts by weight of distilled water was placed into a 133 ml polypropylene cup, having an inside diameter of 6.5 cm at its mouth. An expanded polytetrafluoroethylene (PTFE) membrane having a minimum MVTR of approximately 85,000 g/m$^2$/24 hrs, as tested by the method described in U.S. Pat. No. 4,862,730 (to Crosby), was heat sealed to the lip of the cup to create a taut, leakproof, microporous barrier containing the solution.

A similar expanded PTFE membrane was mounted to the surface of a water bath. The water bath assembly was controlled at 23° C. plus 0.2° C., utilizing a temperature controlled room and a water circulating bath.

The sample to be tested was allowed to condition at a temperature of 23° C. and a relative humidity of 50% prior to performing the test procedure. Samples were placed so the microporous polymeric membrane was in contact with the expanded polytetrafluoroethylene membrane mounted to the surface of the water bath and allowed to equilibrate for at least 15 minutes prior to the introduction of the cup assembly.

The cup assembly was weighed to the nearest 1/1000g and was placed in an inverted manner onto the center of the test sample.

Water transport was provided by the driving force between the water in the water bath and the saturated salt solution providing water flux by diffusion in that direction. The sample was tested for 15 minutes and the cup assembly was then removed, weighed again within 1/1000g.

The MVTR of the sample was calculated from the weight gain of the cup assembly and was expressed in grams of water per square meter of sample surface area per 24 hours.

Resistance to Evaporation of a Textile—Ret Measurement

A means to evaluate the resistance of a material or material set to the transmission of moisture vapor, thus assessing the moisture vapor permeability. Ret is conducted per ISO 11092, 1993 edition, and is expressed in m2Pa/W. Higher Ret values indicate lower moisture vapor permeability.

Air Permeability—Gurley Measurement

The Gurley air flow test measures the time in seconds for 100 cm3 of air to flow through a 6.45 cm2 sample at 12.4 cm of water pressure. Testing is conducted on a Gurley Densometer Model 4340 Automatic Densometer.

Liquid Entry Pressure Measurement

The sample membrane is clamped in an in-line filter holder (Pall, 47 mm, part number 1235). On the one side of the sample membrane is a liquid that is able to be pressurized. On the other side of the sample membrane, which is open to atmospheric pressure, a piece of colored paper is placed between the sample membrane and a support (perforated plexiglass disk). The sample is then pressurized in 17 kPa increments, waiting 60 seconds after each pressure increase. The pressure that a color change in the paper occurs is recorded as the entry pressure. The liquid used is about 30% IPA-70% water (vol-vol), which results in a liquid surface tension of about 31 dynes/cm (+/−about 1) determined by pendant drop method. Two samples were measured and averaged to provide the initial liquid entry pressure ($EP_{initial}$).

Oil Rating or Oil Repellency Measurement

Oil rating of both membranes and fabric laminates are measured using the AATCC Test Method 118-1997. The oil rating of a membrane sample is the lower of the two ratings obtained when testing the two sides of the membrane; for fabric laminates, the oil rating is tested on the exposed membrane side of the fabric laminate. A higher oil rating number indicates a better oil repellency.

Garment Flammability Test Method

Test garments were evaluated for resistance to a simulated flash fire exposure employing procedures similar to ASTM F 1930-00 Standard Test Method for Evaluation of Flame Resistant Clothing for Protection Against Flash Fire Simulations Using an Instrumented Manikin. Prior to testing, a nude manikin calibration was done with a four seconds exposure. After calibration, a cotton t-shirt (size 42 regular, weighing between 4 oz/yd.sup.2 and 7 oz/yd.sup.2) and a cotton short (size M) were put on followed by the jacket made of laminates described below (size 42 regular). In some tests, approximately 7.5 oz/yd.sup.2, size 42 regular middle layer of clothing was put on the manikin between the cotton base layer and outer garment of this invention. After dressing the manikin, a computer system was used to control the test procedure, to include the lighting of pilot flames, exposing the test garment to the flash fire, acquisition of data for 120-seconds, followed by running the exhaust fans to vent the chamber. Data acquired by the system was used to calculate the incident heat flux, predicted burn injury for each sensor during and after the exposure, and produce a report and graphics for each test. Any continued flaming after exposure was noted, and afterflame and melt dripping or falling of droplets was also noted. The predicted burn injury data along with afterflame and melt dripping observations is reported. The predicted burn injury is calculated by dividing the total number of sensors that reach 2.sup.nd and 3.sup.rd degree burn by the number of sensors in the area covered by the test garment. The total percent body burn reported is the sum of the 2.sup.nd and 3.sup.rd degree predicted burn injury percentages.

EXAMPLES

Comparative Example A

Two conventional firefighter's turnout garments of a typical garment style were constructed from a conventional composite commonly found in the industry. The composite layup consisted of an outer shell layer of TenCate ADVANCE™ fabric, a 7.5 oz/yd$^2$ woven textile comprising 60% para-aramid, 40% meta-aramid (TenCate Protective Fabrics, Inc.) layered next to a non-air permeable moisture barrier (CROSSTECH® Black Moisture Barrier, a 4.7 oz/yd$^2$ laminate, W. L. Gore and Associates, Inc.) and then an insulation layer (Caldura® Silver SL2, 7.6 oz/yd$^2$ containing a 100% meta-aramid facecloth with two layers of E89, from TenCate Protective Fabrics, Inc.). The conventional garment was constructed in such a way that the insulation layer was on the inner surface of the garment closest to the manikin and the outer shell material was on the outer surface of the garment.

The garments were tested according to ASTM F1930-11 with a 12 second flame exposure. A men's medium 100% cotton short-sleeved T-Shirt and briefs were worn beneath the test garments. The manikin head area was un-protected.

Results of the test showed that the average value for predicted second-degree burn was 33.2% and the average value for predicted third-degree burn was 20.5%, and the predicted total burn injury was 53.7%.

The value for predicted third-degree burn includes a value of approximately 6.5% for the unprotected head.

Example 1

Two firefighter's turnout garments were constructed according to an embodiment of the present invention. The outer shell layer was a Tencate Advance™ fabric, a 7.5 oz/yd$^2$ woven textile comprising 60% para-aramid, 40% meta-aramid. A second layer comprising an air permeable, oleophobic expanded PTFE membrane (W. L. Gore and Associates, Inc., Elkton, Md.) was laminated to a 3.3 ounce/yd$^2$ flame resistant textile, consisting of 93% meta-aramid fibers, 5% para-aramid fibers, and 2% carbon fibers. The layer was oriented with the flame resistant textile next to the outer shell layer. A third layer comprising an air permeable, oleophobic, expanded PTFE membrane (W. L. Gore and Associates, Inc.) laminated to a 120 g/m$^2$ non-woven fabric consisting of 30% Basofil®, 35% Nomex®, and 35% Kevlar®. The layer was oriented with the air permeable, oleophobic membrane next to the second layer. A fourth layer comprising an oleophobic, non-air permable, bi-component expanded PTFE membrane comprising a moisture vapor permeable urethane coated on and partially within the ePTFE membrane was laminated to a 4.5 oz/yd$^2$ woven textile consisting of 50% Viscose and 50% Nomex®. The layer was oriented with the air impermeable, oleophobic, ePTFE next to the third layer. The garment was constructed in such a manner that and the 50% Viscose, 50% Nomex® woven textile was on the inner surface of the garment and the outer shell layer was on the outer surface of the garment. The measured composite thickness was 0.108 inches and the measured composite weight was 21.6 oz/yd$^2$.

The garments were tested according to ASTM F1930-11 with a 12 second flame exposure. A men's medium 100% cotton short-sleeved T-Shirt and briefs were worn beneath the test garments. The manikin head area was un-protected.

Results of the test showed that the average value for predicted second-degree burn was 27.5% and the average value for predicted third-degree burn was 7.8%, and the predicted total burn injury was 35.3%.

TABLE 1

| Composite | % 2$^{nd}$ Degree | % 3$^{rd}$ Degree | Total % Body Burn | Average % Burn |
|---|---|---|---|---|
| Comparative Example A—first garment | 39.344 | 20.492 | 59.84 | 50.4 |
| Comparative Example A—second garment | 27.049 (average: 33.2) | 20.492 (average: 20.5) | 47.54 (average: 53.7) | |
| Example 1—first garment | 27.869 | 8.197 | 36.07 | 30.7 |
| Example 1—second garment | 27.049 (average: 27.5 | 7.377 (average: 7.8) | 34.43 (average: 35.5) | |

The information in Table 1 was input into a model that calculates the average total percent body burn from replicates, which is shown in the far right column. Based on this, it was found that the average percent burn for the sample garment created according to Example 1 of the invention was significantly lower (30.7%) than that for the Comparative Example A garments that were tested (50.4%). Further, as seen in Table 1, the sample garments created according to Example 1 provide a much higher protection against 3$^{rd}$ degree burns than the Comparative Example A garments, which is an in important benefit in fire protection garments.

Comparative Example B

A typical firefighting composite was assembled as in Comparative Example A, except the outer shell was TenCate GEMINI™ XT fabric, a 7.5 oz/yd$^2$ woven textile comprising 60% para-aramid, 40% polybenzimidazole (Tencate Protective Fabrics, Inc.). The measured composite thickness was 0.11 inches and the measured composite weight was 21.5 oz/yd$^2$.

Composite specimens of the construction described were evaluated in a subflashover exposure using ASTM F2731-11. An additional 5.4 oz/yd$^2$ cotton knit textile was added to the inner side of the composite to simulate an underlayer worn in the field. Specimens were preconditioned either dry as per the ASTM F2731-11 method or with a wet precondition. The wet preconditioning step consisted of applying 13 grams of water to the cotton knit layer, assembling the composite layers and sealing the composite in an air tight, water tight bag, at 21° C. for 18-24 hours. When tested, the test specimens were placed in the sample holder and the cotton layer was in contact with the sensor. The specimens were exposed to a radiant flux per the ASTM F2731 method for a time sufficient to achieve a predicted time to second-degree burn.

The average predicted time to second-degree burn for the dry preconditioned specimens was 286 seconds. The average predicted time to second-degree burn for the wet preconditions specimens was 187 seconds.

Example 2

A firefighting composite according to the present invention was assembled as in Example 1, except the outer shell was Tencate GEMINI™ XT fabric, a 7.5 oz/yd$^2$ woven textile comprising 60% para-aramid, 40% polybenzimidazole (Tencate protective fabrics, Inc.). The measured composite thickness was 0.10 inches and the measured composite weight was 21.2 oz·yd$^2$.

Specimens of the firefighting composite were evaluated in a subflashover exposure using ASTM F2731-11. An additional 5.4 oz/yd$^2$ cotton knit textile was added to the inner side of the composite to simulate an underlayer worn in the field. Specimens were preconditioned either dry as per the ASTM F2731-11 method or with a wet precondition. The wet preconditioning step consisted of applying 13 grams of water to the cotton knit layer, assembling the composite layers and sealing the composite in an air tight, water tight bag, at 21° C. for 18-24 hours. When tested, the test specimens were placed in the sample holder and the cotton layer was in contact with the sensor. The specimens were exposed to a radiant flux per the ASTM F2731 method for a time sufficient to achieve a predicted time to second-degree burn.

The average predicted time to second-degree burn for the dry preconditioned specimens was 274 seconds. The average predicted time to second-degree burn for the wet preconditions specimens was 255 seconds.

While particular embodiments of the present disclosure have been illustrated and described herein, the present disclosure should not be limited to such illustrations and descriptions. It should be apparent that changes and modifications may be incorporated and embodied within the scope of the following claims.

What is claimed is:

1. A protective garment comprising:

an outer layer;

an air permeable, liquid water resistant membrane;

an insulation;

an air impermeable, liquidproof, moisture vapor permeable membrane, wherein the air permeable, liquid water resistant membrane is positioned closer to the outer layer than the air impermeable, liquid proof, moisture vapor permeable membrane, and the insulation is located between the air permeable, liquid water resistant membrane and the air impermeable, liquidproof, moisture vapor permeable membrane.

2. The protective garment of claim 1, wherein the air permeable, liquid water resistant membrane is contained within a separable component comprising fire resistant textiles.

3. The protective garment of claim 1, wherein the air impermeable, liquidproof, moisture vapor permeable membrane is contained within a separable component comprising fire resistant textiles.

4. The protective garment of claim 1, wherein the insulation is in a separable layer positioned between the air permeable, liquid water resistant membrane and the air impermeable, liquidproof, moisture vapor permeable membrane.

5. The protective garment of claim 1, wherein at least a portion of the insulation is attached to said air permeable, liquid water resistant membrane.

6. The protective garment of claim 1 wherein at least a portion of the insulation is attached to said air impermeable, liquidproof moisture vapor permeable membrane.

7. The protective garment of claim 1 wherein the insulation comprises a first portion of insulation attached to said air permeable, liquid water resistant membrane, a second portion of insulation attached to said air impermeable, liquidproof, moisture vapor permeable membrane, and a third portion of insulation incorporated as a separable component between the first portion and the second portion.

8. The protective garment of claim 1 wherein the air permeable, liquid water resistant membrane has a moisture vapor transmission rate (MVTR) at least 2 times greater than the MVTR of the air impermeable, liquidproof, moisture vapor permeable membrane.

9. The protective garment of claim 1 wherein the air permeable, liquid water resistant membrane comprises an oleophobic film.

10. The protective garment of claim 1 wherein the air impermeable, liquidproof, moisture vapor permeable membrane comprises an oleophobic film.

11. The protective garment as defined in claim 1 wherein the air permeable, liquid water resistant membrane has at least a 30% higher moisture vapor transmission rate than said air impermeable, liquid proof moisture vapor permeable membrane.

12. The protective garment of claim 1 or claim 2, wherein the air permeable, liquid water resistant membrane is incorporated within a laminate of flame-resistant materials and comprises an oleophobic expanded PTFE membrane, and said air impermeable, liquidproof, moisture vapor permeable membrane is incorporated within a laminate of flame-resistant materials and comprises a bi-component expanded PTFE membrane.

13. A protective garment comprising:

an outer layer;

an air permeable, liquid water resistant membrane;

an insulation;

an air impermeable, liquidproof, moisture vapor permeable membrane, wherein the air permeable, liquid water resistant membrane is positioned closer to the outer layer than the air impermeable, liquid proof, moisture vapor permeable membrane, and the insulation is located between the air permeable, liquid water resistant membrane and the air impermeable, liquidproof, moisture vapor permeable membrane, and wherein the air permeable, liquid water resistant membrane, the insulation, and the air impermeable, liquidproof moisture vapor permeable membrane are separable across their surfaces.

14. A method of simultaneously protecting insulative materials from bulk liquid absorption while directing heated moisture vapor away from the skin of a protective garment wearer comprising the steps of:

(a) providing an air permeable, liquid water resistant membrane;

(b) providing insulation;

(c) providing an air impermeable, liquidproof, moisture vapor permeable membrane; and (d) arranging the materials of (a), (b) and (c) in a protective garment to be worn by a wearer such that said air impermeable, liquid proof, moisture vapor permeable membrane is closer to the wearer and the air permeable, liquid water resistant layer is closer to the exterior of the garment, and said insulation is arranged therebetween.

15. The method as defined in claim 14 wherein said air permeable, liquid water resistant membrane has a moisture vapor permeability which is higher than the moisture vapor permeability of said air impermeable, liquidproof, moisture vapor permeable membrane.

16. A method as defined in claim 14, further comprising an outer shell arranged to the exterior relative to the air permeable, liquid water resistant membrane.

17. The protective garment of claim 1, wherein the subflashover protection time with 13 gsm moisture exposure to a 5.4 osy cotton jersey knit fabric tested with said cotton jersey knit fabric in contact with the sensor and a ¼" gap between the sensor and the garment layers is at least 75% of the subflashover protection time with the same layers with no moisture exposure.

18. The protective garment of claim 1, wherein said garment is compliant to NFPA 1971 Standard, 2007 edition, with an Ret of less than 25 m2 Pa/W.

19. The protective garment of claim 1, wherein said garment is compliant to the EN 469 Standard, 2005 edition, Level 2, with an Ret of less than 20 m2 Pa/W.

20. The protective garment of claim 1, further comprising at least one additional air impermeable, liquidproof, moisture vapor permeable membrane oriented between said air permeable, liquid water resistant membrane and said air impermeable, liquidproof, moisture vapor permeable membrane.

21. The protective garment of claim 20, wherein said at least one additional air impermeable, liquidproof, moisture vapor permeable membrane is oriented adjacent and contacts said air impermeable, liquidproof, moisture vapor permeable membrane.

22. The protective garment of claim 1, wherein said garment is in the form of separable layers assembled as a garment system.

23. The protective garment of claim 1, wherein said garment has a total percent body burn performance of 45% or less.

24. The protective garment of claim 1, wherein said garment has a total percent body burn performance of 40% or less.

25. The protective garment of claim 1, wherein said garment has a total percent body burn performance of 37% or less.

26. The protective garment of claim 1, wherein the insulative material comprises a continuous or discontinuous silicone foam, a non-woven material, a woven material, a knitted material, or a three-dimensionally shaped material.

27. The protective garment of claim 13, wherein the insulative material comprises a continuous or discontinuous silicone foam, a non-woven material, a woven material, a knitted material, or a three-dimensionally shaped material.

28. The method of claim 14, wherein the insulative material comprises a continuous or discontinuous silicone foam, a non-woven material, a woven material, a knitted material, or a three-dimensionally shaped material.

* * * * *